US009788645B2

(12) United States Patent
Bonuccelli

(10) Patent No.: US 9,788,645 B2
(45) **Date of Patent: *Oct. 17, 2017**

(54) TELESCOPIC LEG FOR A TABLE

(71) Applicant: UNIFOR S.P.A., Turante, Como (IT)

(72) Inventor: Dante Bonuccelli, Como (IT)

(73) Assignee: UNIFOR S.P.A., Turate, Como (IT)

( * ) Notice: Subject to any disclaimer, the term of this patent is extended or adjusted under 35 U.S.C. 154(b) by 0 days.

This patent is subject to a terminal disclaimer.

(21) Appl. No.: 15/100,375

(22) PCT Filed: Dec. 16, 2014

(86) PCT No.: PCT/IB2014/066981

§ 371 (c)(1),
(2) Date: May 31, 2016

(87) PCT Pub. No.: WO2015/092688

PCT Pub. Date: Jun. 25, 2015

(65) Prior Publication Data

US 2016/0296006 A1 Oct. 13, 2016

(30) Foreign Application Priority Data

Dec. 16, 2013 (IT) ..... M12013A2097

(51) Int. Cl.
*A47B 9/00* (2006.01)
*A47B 9/20* (2006.01)

(52) U.S. Cl.
CPC ..... *A47B 9/20* (2013.01)

(58) Field of Classification Search
CPC ..... A47B 9/20
(Continued)

(56) References Cited

U.S. PATENT DOCUMENTS 4,711,184 A * 12/1987 Wallin ..... A47B 9/10 108/147
5,285,733 A * 2/1994 Waibel ..... A47B 9/20 108/147.19

(Continued)

FOREIGN PATENT DOCUMENTS

DE 20017804 U1 2/2002
DE 20211968 U1 11/2002

(Continued)

OTHER PUBLICATIONS

EP2422647 English Translation, Nov. 29, 2016.*

(Continued)

*Primary Examiner* — Matthew Ing
(74) *Attorney, Agent, or Firm* — Thomas Horstemeyer, LLP

(57) ABSTRACT

A telescopic leg for supporting a table-top of a table, the leg defining an extension axis, a first end of the leg, and a second end of the leg, opposite the first end, wherein the length of the leg between the first end and the second end is adjustable between a minimum length and a maximum length, wherein the telescopic leg includes: a plurality of leg members slidingly engaged with each other along the extension axis; the plurality of leg members including a first leg member terminating with the first end, suitable to rest on the floor or be fixed to a base, and a last leg member terminating with the second end and suitable to be fixed to the table-top; wherein the last leg member is an extruded tubular member internally defined by a tubular member inner surface.

13 Claims, 14 Drawing Sheets

(58) Field of Classification Search
USPC ..... 108/144.11, 147, 147.19, 147.21; 248/188.5
See application file for complete search history.

(56) References Cited

U.S. PATENT DOCUMENTS

| | | | | | |
|---|---|---|---|---|---|
| 5,579,557 | A * | 12/1996 | Boden | B25G 1/04 | 15/144.4 |
| 5,809,908 | A * | 9/1998 | Catta | A47B 9/12 | 108/147 |
| 6,029,587 | A * | 2/2000 | Rozier, Jr. | A47B 9/14 | 108/147.21 |
| 7,246,779 | B2 * | 7/2007 | Doyle | A47B 9/04 | 108/144.11 |
| 8,196,879 | B2 * | 6/2012 | Vezina | A47G 19/00 | 108/101 |
| 2003/0033963 | A1 * | 2/2003 | Doyle | A47B 9/04 | 108/147.19 |
| 2011/0048291 | A1 * | 3/2011 | Long | A47B 9/02 | 108/147 |

FOREIGN PATENT DOCUMENTS

| | | | |
|---|---|---|---|
| DE | 202007017245 | U1 | 2/2008 |
| EP | 2422647 | A1 | 2/2012 |

OTHER PUBLICATIONS

International Search Report for PCT/IB2014/066981 mailed Mar. 26, 2015.
English translation of the Abstract for EP 2422647 published on Feb. 29, 2012.
English translation of the Abstract for DE 20211968 published on Nov. 28, 2002.
English translation of the Abstract for DE 20017804 published on Feb. 28, 2002.
English translation of the Abstract for DE 202007017245 published on Feb. 28, 2008.

* cited by examiner

FIG. 16
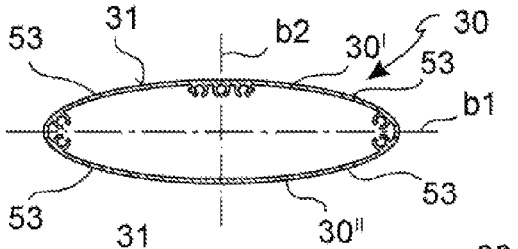
FIG. 17
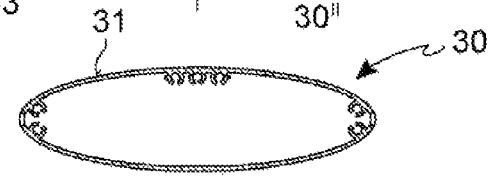
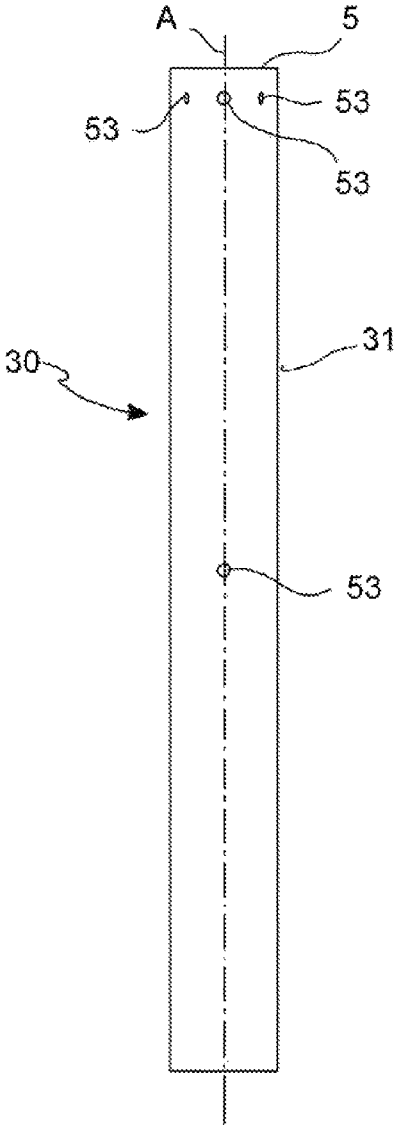
FIG. 18
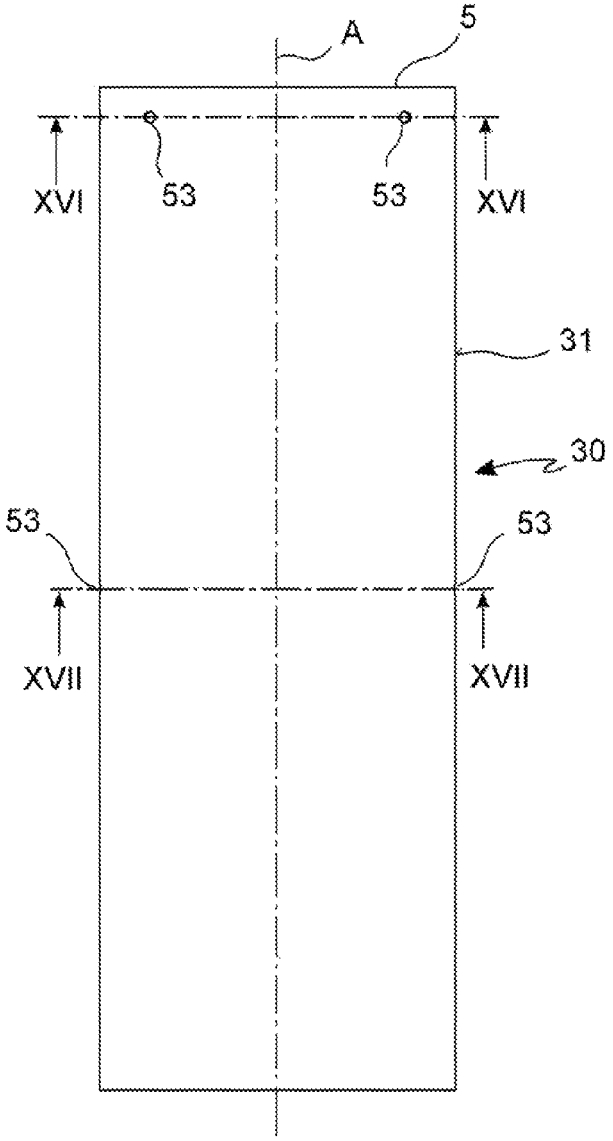
FIG. 19

FIG. 20
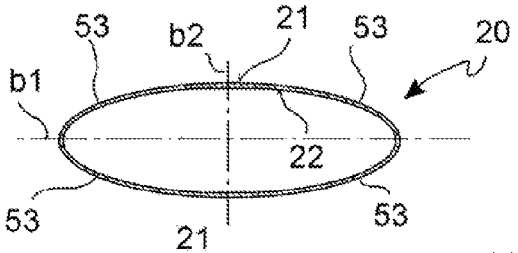
FIG. 21
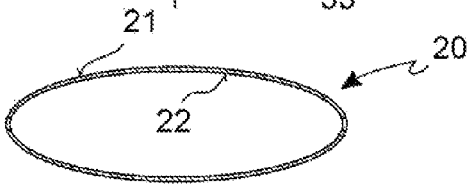
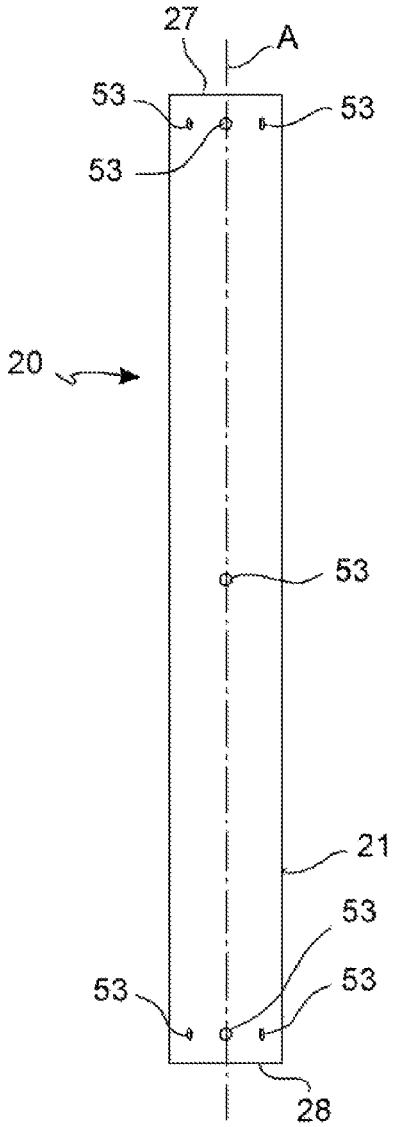
FIG. 22
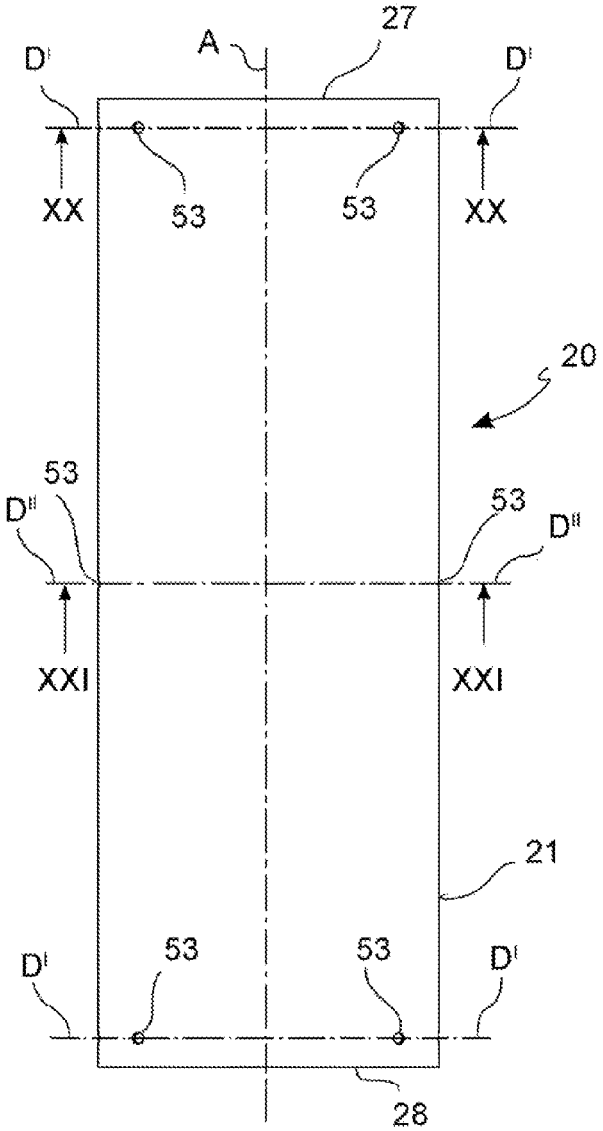
FIG. 23

TELESCOPIC LEG FOR A TABLE

CROSS-REFERENCE TO RELATED APPLICATION

This application is the 35 U.S.C. §371 national stage application of PCT Application No. PCT/IB2014/066981, filed Dec. 16, 2014, where the PCT claims priority to and the benefit of, IT Patent Application No. MI2013A002097, filed Dec. 16, 2013, both of which are herein incorporated by reference in their entirety.

FIELD OF THE INVENTION

The object of this invention is a height-adjustable leg suitable to support a work-top, or a table-top of a table. This invention also refers to a table having at least one such height-adjustable leg.

STATE OF THE ART

In the production of furniture and, in particular, tables, the use of height-adjustable legs is a well-known technique for bringing and holding the table-top of the table at a desired height above the floor.

In particular, there are telescopic legs that extend along an elongation axis that is generally vertical and, in particular, formed by several segments, or members, that slide each other, one inside the other.

Generally, in addition to the design requirement to supply furniture with a linear and minimalist appearance, there are also the needs of comfort of use, structural soundness and quality of the final product.

In particular, a need to provide a height-adjustable and structurally solid table is felt, that, at the same time, leaves the space below the table as free as possible so that the user may arrange his/her legs comfortably under the table-top.

First of all, meeting this need requires using the fewest number of legs possible and, preferably, only one leg.

Moreover, this need requires that such adjustable or telescopic legs are placed near a peripheral edge of the table-top of the table, supporting the table-top in a cantilevered manner.

A telescopic leg mounted laterally near one edge of the table-top is inevitably subject to high bending stress.

In fact, assuming that the centre of gravity of the weight forces of the table-top, and of any objects placed on it, is approximately at the centre of the table, if the leg supports the table-top near its edge, these weight forces apply a bending moment to the leg, tending to flex and bend the leg on one side.

This can cause malfunctions in the movement of the telescopic leg, such as jamming and instability, but also reduced work safety, in addition to creating a sensation of poor construction quality.

The need to hide an actuator inside the leg to allow the leg to be lengthened or shortened requires that the members of the leg be hollow, thereby reducing their mechanical strength.

Then, the conflicting requirements of providing a hollow leg to hide actuator inside and providing a leg resistant to bending to support, in particular in a single unit, the table-top fixed cantilevered with respect to the leg, make it even more unthinkable and impossible the use of a known telescopic leg for such an application.

This latter need to support the table-top by means of a single leg near one edge of the table-top, not satisfied by the prior art, is particularly felt for both aesthetic and functional reasons and, in fact, such a solution would provide both a linear and minimalist aesthetic line and comfort of use, leaving all the space below the table-top free for arranging the legs of the user.

SUMMARY OF THE INVENTION

The purpose of this invention is to devise and provide available an adjustable table leg that meets the above needs and, at least partially, overcomes the drawbacks complained about above with reference to the prior art.

In particular, the task of this invention is to provide a telescopic leg for supporting a table, which can be used in a few units, or in a single unit, to fully support a table-top projecting in a cantilevered manner, near one edge of the table-top.

Another task of this invention is to provide a height-adjustable telescopic leg for a table that is structurally very strong and stable and that, at the same time, is structurally simple, avoiding the need for a large number of components.

Another purpose of this invention is to provide a height-adjustable leg for a table that can hold the table solidly and rigidly in its height position when the table-top is brought to the desired height, avoiding misalignments, play and vibration among the members of the leg.

A further purpose of this invention is to provide a telescopic leg that allows containing, inside of it all the actuation components that allow the lengthening/shortening movement of the leg.

Another purpose of this invention is to provide a height-adjustable leg that can be operated in a fluid, smooth, quiet and safe manner, avoiding jamming and vibration.

These and further purposes and advantages are achieved by means of an adjustable leg according to claim 1.

Such an adjustable leg, while having a simple, linear construction, is structurally very strong and especially suited to supporting a lateral load.

In fact, reinforcement ribs are arranged asymmetrically with respect to a first longitudinal plane and are, then, concentrated on one side of the tubular member, which, in this way, is particularly suited to supporting a tensile load generated by the bending torque described above.

In other words, if the leg is mounted in support of the table-top, near an edge of such table-top, by angularly orienting the leg about its axis so that the main bundle of ribs is arranged towards the outside of the table, this main bundle functions as a tie-rod.

In a particularly advantageous embodiment of this invention, the ribs of the main bundle include respective longitudinal channels to receive and retain a respective fixing screw to fix the table-top to the upper end member of the telescopic leg.

Such a provision allows applying the above-mentioned tensile force generated by the decentralized or lateral load, directly to the ribs of the main bundle and, in particular, exclusively in these ribs, so as to use these ribs precisely as tie-rods.

Such a solution makes the telescopic leg particularly strong and stable.

One of the main advantages of this invention is provided by the fact that the main bundle of ribs of the last member of the leg acts as a bundle of tie-rods hidden inside and integrated into the structure of the leg and is able to solidly support a work-top that is highly cantilevered with respect to the telescopic leg.

Furthermore, this also allows forming the telescopic leg with a flattened, for example elliptical, cross section that extends in a direction substantially orthogonal to the cantilever direction of the table-top, more than in a direction which is substantially parallel to said cantilever direction.

FIGURES

Further characteristics and advantages of this invention will result from the following description of preferred embodiments, provided as non-limiting examples, with reference to the accompanying figures, wherein:

FIGS. 16 and 17 show cross sections, orthogonal to the extension axis, of the top end member of the leg, cut, respectively, by sectional planes XVI and XVII orthogonal to the extension axis;

FIG. 18 shows a side view of the top end member of the leg, in a direction orthogonal to the extension axis and in a direction parallel to the minor axis of the cross section;

FIG. 19 shows a side view of the top end member of the leg, in the direction of the minor axis of the cross section;

FIGS. 20 and 21 show cross sections, orthogonal to the extension axis, of a central member of the leg, cut, respectively, by the sectional planes XX and XXI orthogonal to the extension axis;

FIG. 22 shows a side view of the such central leg member, in a direction orthogonal to the extension axis and in a direction parallel to the minor axis of the cross section;

FIG. 23 shows a side view of such central leg member, in a minor axis direction of the cross section;

DESCRIPTION OF SEVERAL PREFERRED EMBODIMENTS

Figure 1:
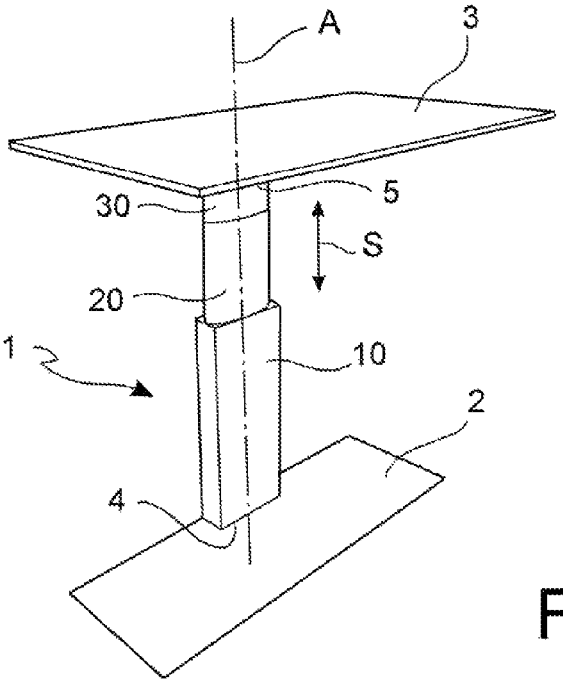
FIG. 1 shows a perspective view of a possible application of an adjustable leg according to the invention to support a height-adjustable table.
Figure 2:
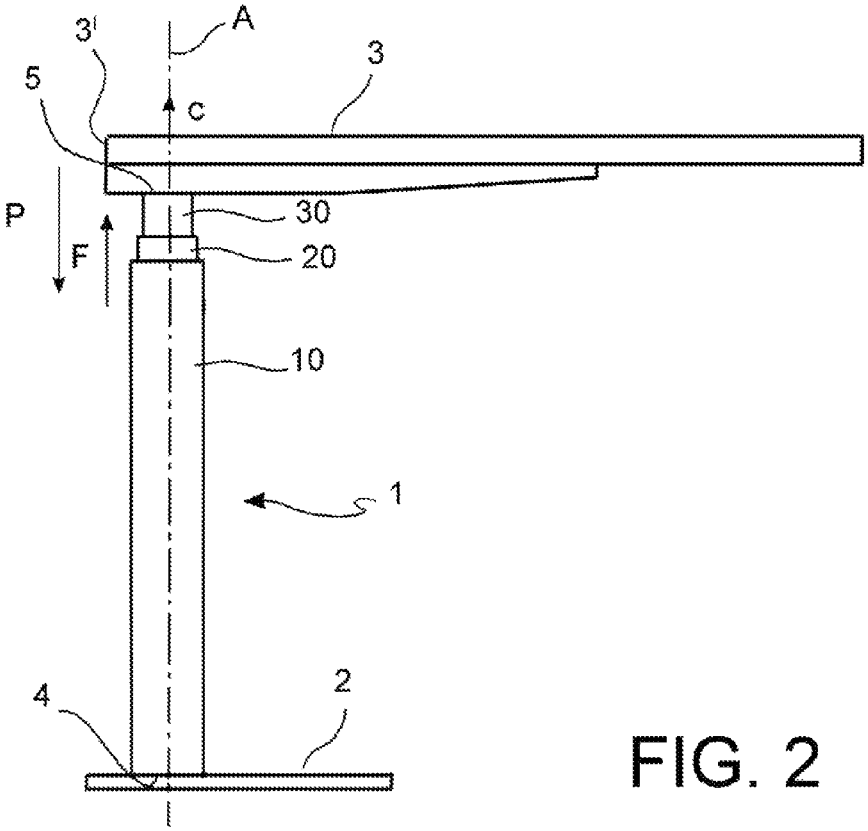
FIG. 2 shows a side view of the table and the adjustable leg of FIG. 1.
Figure 3:
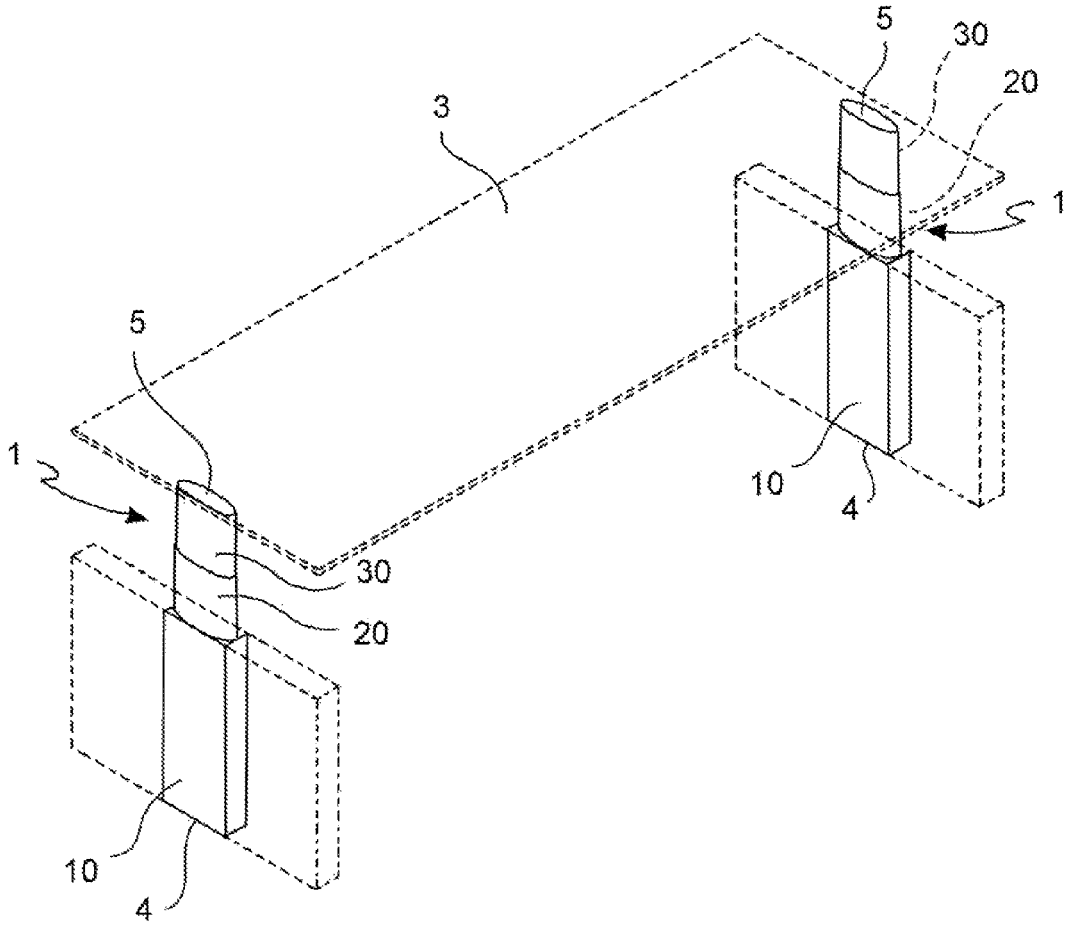
FIG. 3 shows a perspective view of a further embodiment of a table comprising a pair of adjustable legs according to the invention.
Figure 4:
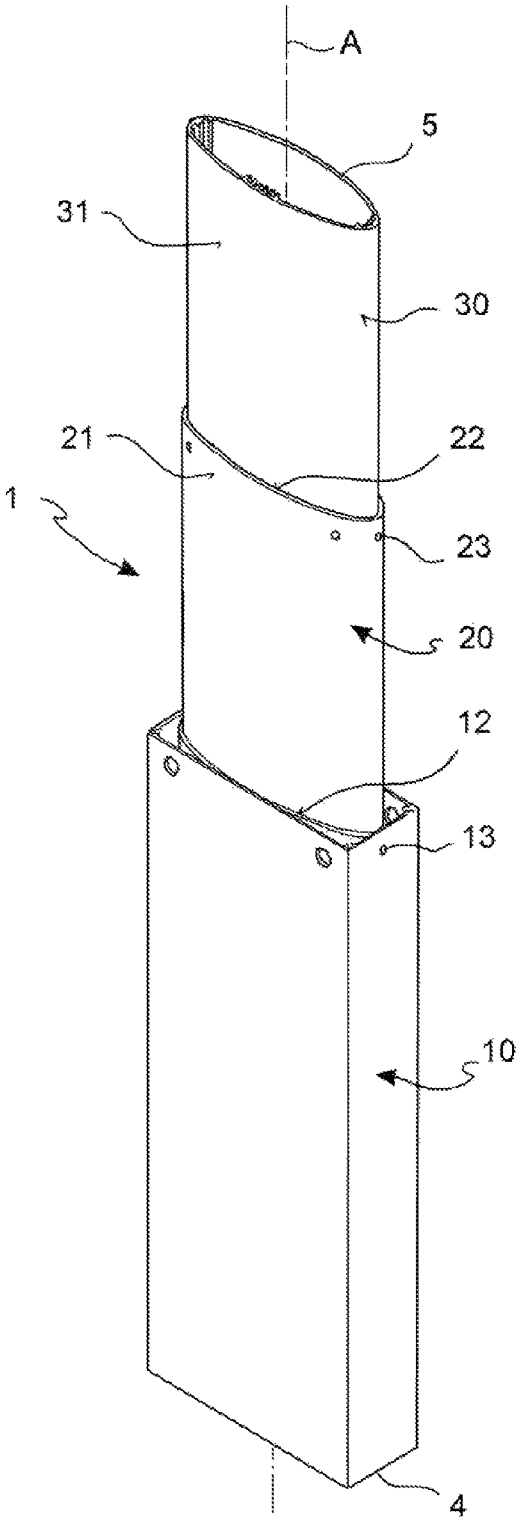
FIG. 4 shows a perspective view of an adjustable leg according to the invention, having an elliptical cross section, shown in the extended, or raised, position.
Figure 5:
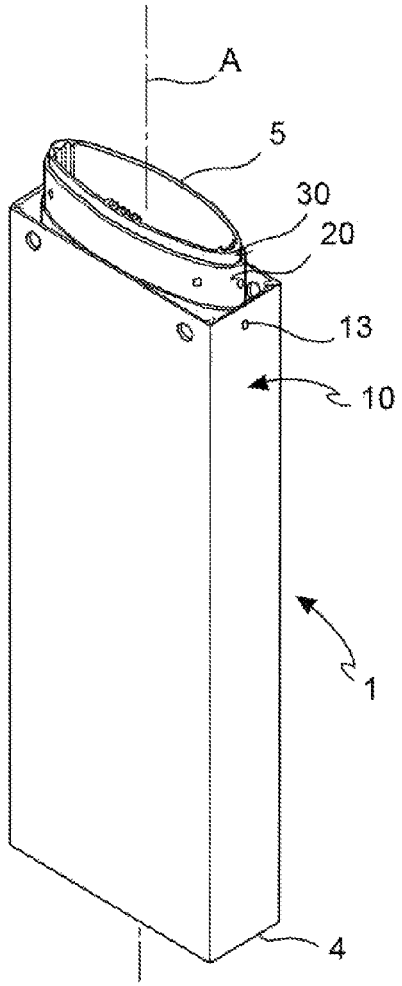
FIG. 5 shows a perspective view of the leg of FIG. 4, shown in the retracted, or lowered, position.
Figure 6:
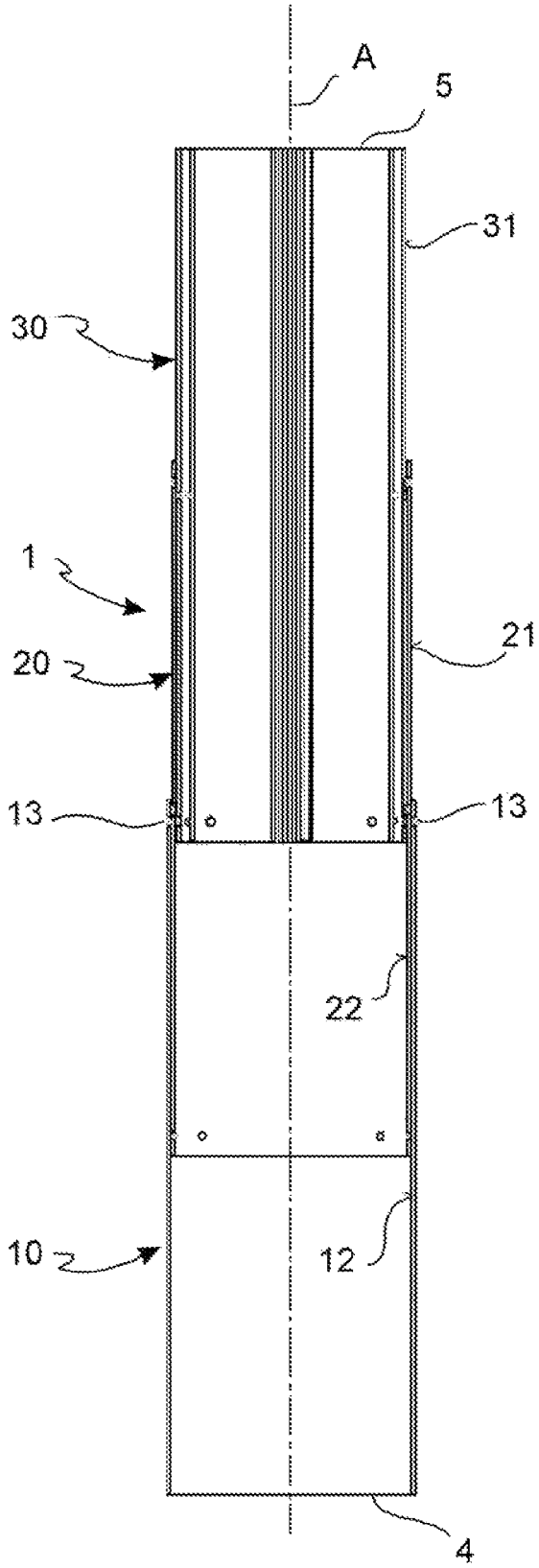
FIG. 6 shows a longitudinal sectional view of the leg of FIG. 4 cut by plane VI passing through the extension axis of the leg and through the major axis of the elliptical cross section, wherein the leg is in the extended position.
Figure 7:
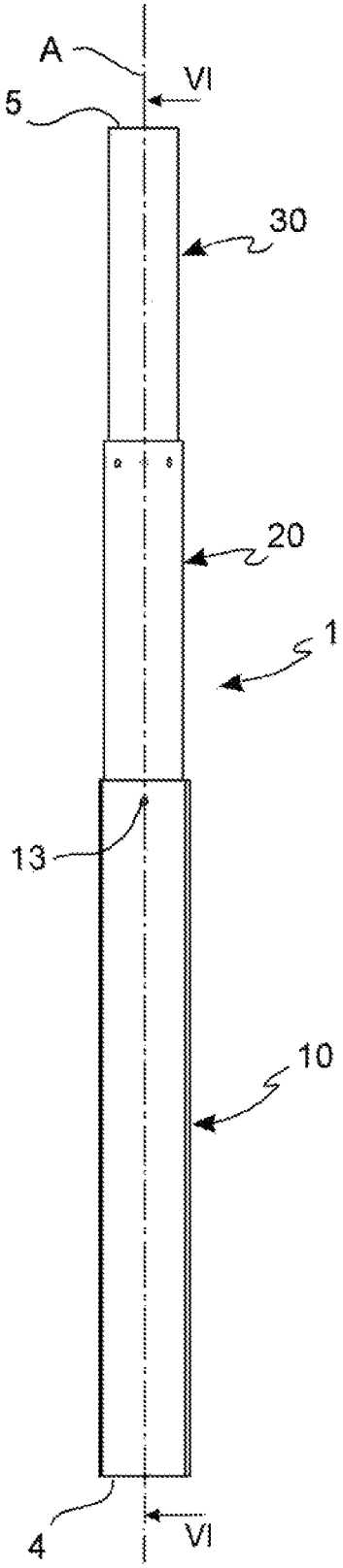
FIG. 7 shows a side view of the leg in the extended position, in a direction orthogonal to the extension axis and in the direction parallel to the major axis of the elliptical cross section of the leg.
Figure 8:
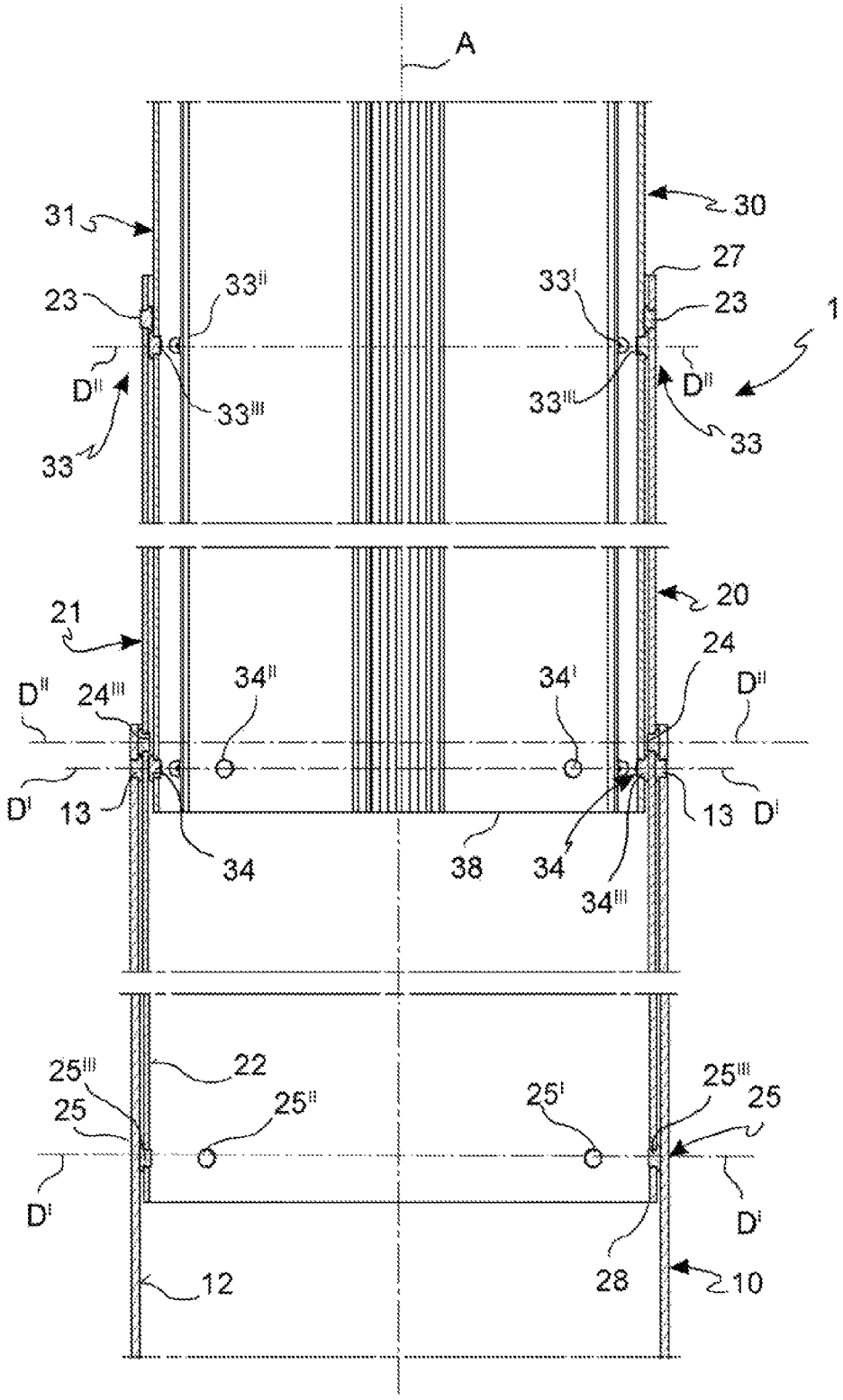
FIG. 8 shows an enlarged detail of the sectional view of FIG. 6, in which intermediate portions of the leg portions have been removed for reasons of simplicity of illustration.
Figure 9:
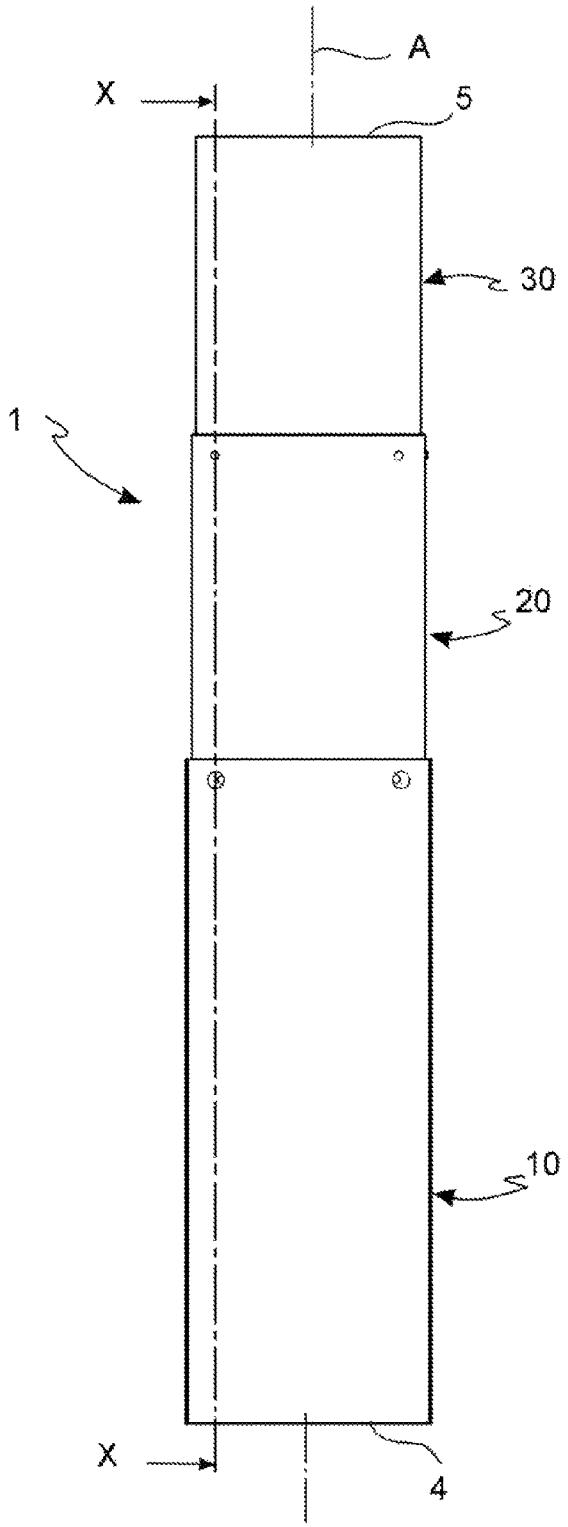
FIG. 9 shows a side view of the elliptical cross section leg of FIG. 4, in a direction orthogonal to the extension axis and in the direction parallel to the minor axis of the elliptical cross section of the leg.
Figure 10:
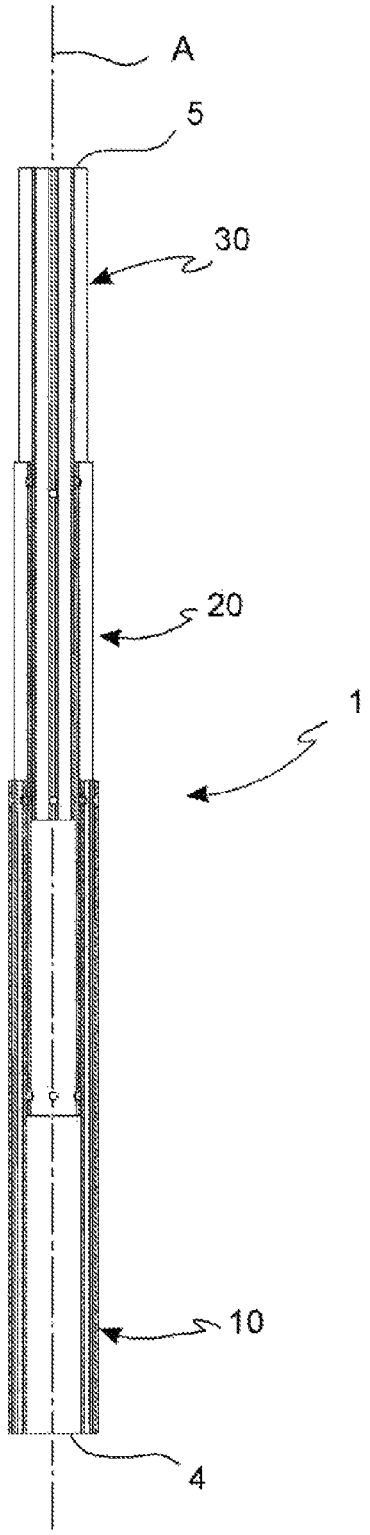
FIG. 10 shows a sectional view, cut by a longitudinal plane X, of the leg of FIG. 4, wherein such a plane is parallel to the extension axis of the leg and parallel to the minor axis of the elliptical cross section of the leg, wherein such plane passes in correspondence of the pulling members interposed among the leg members.
Figure 11:
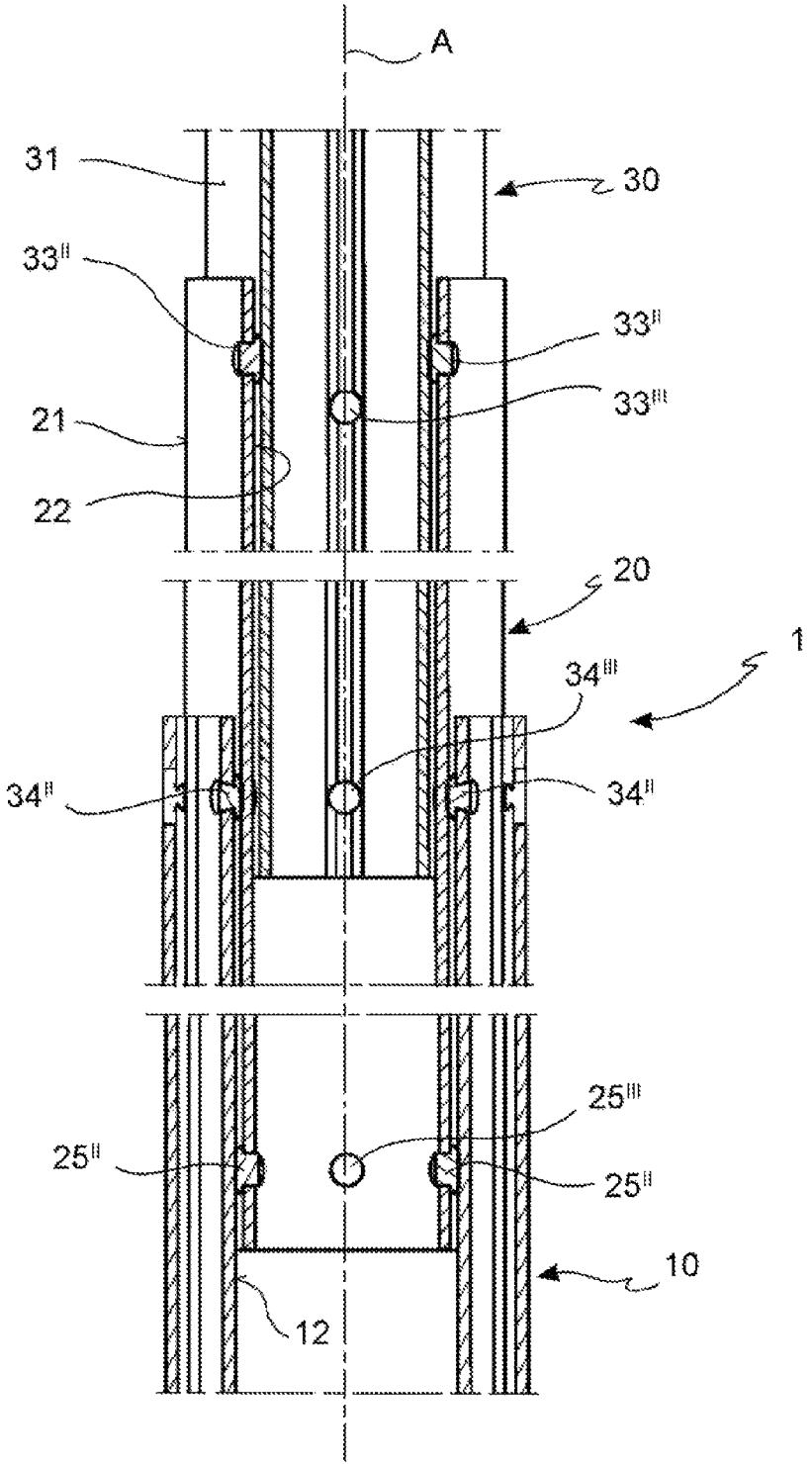
FIG. 11 shows an enlarged detail of the sectional view of FIG. 10, wherein intermediate portions of the leg portions have been removed for reasons of simplicity of illustration.
Figure 12:
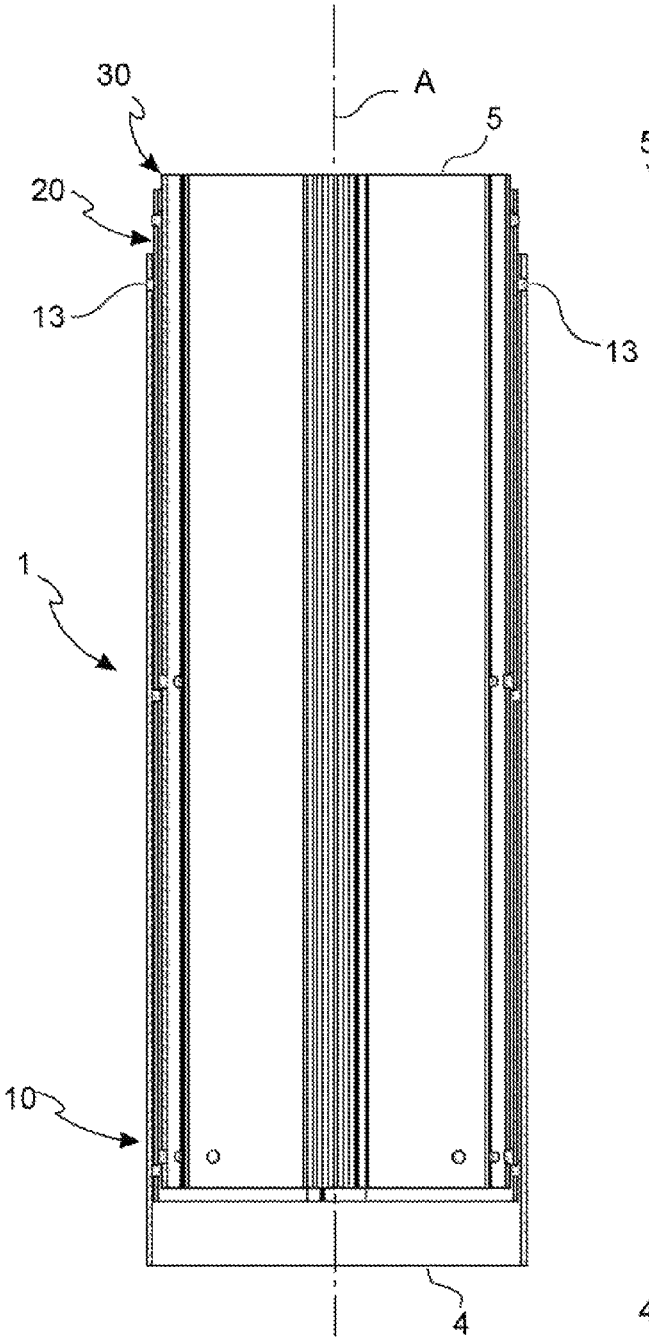
FIG. 12 shows a sectional view of the leg shown in FIG. 6, cut by a sectional plane XII coincident with plane VI, wherein the leg is in the retracted position.
Figure 13:
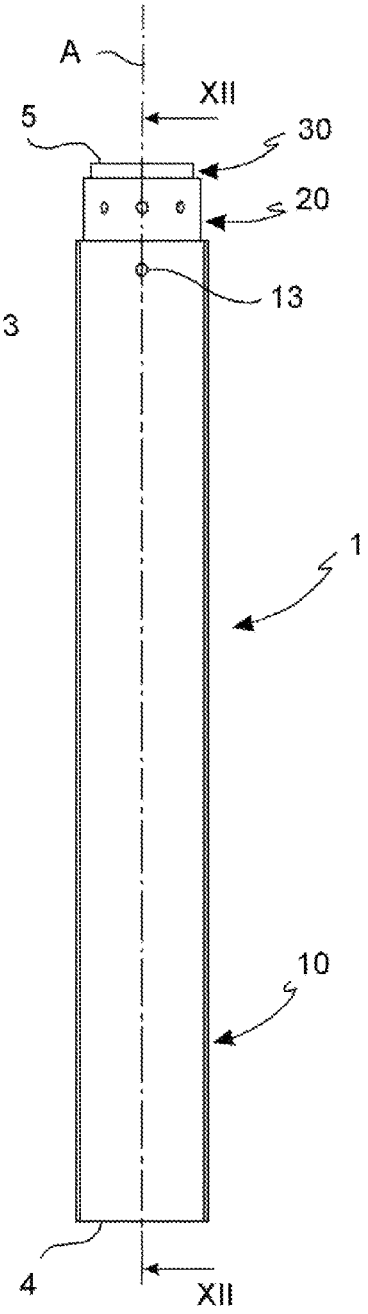
FIG. 13 shows the side view of FIG. 7, wherein the leg is in the retracted position.
Figure 14:
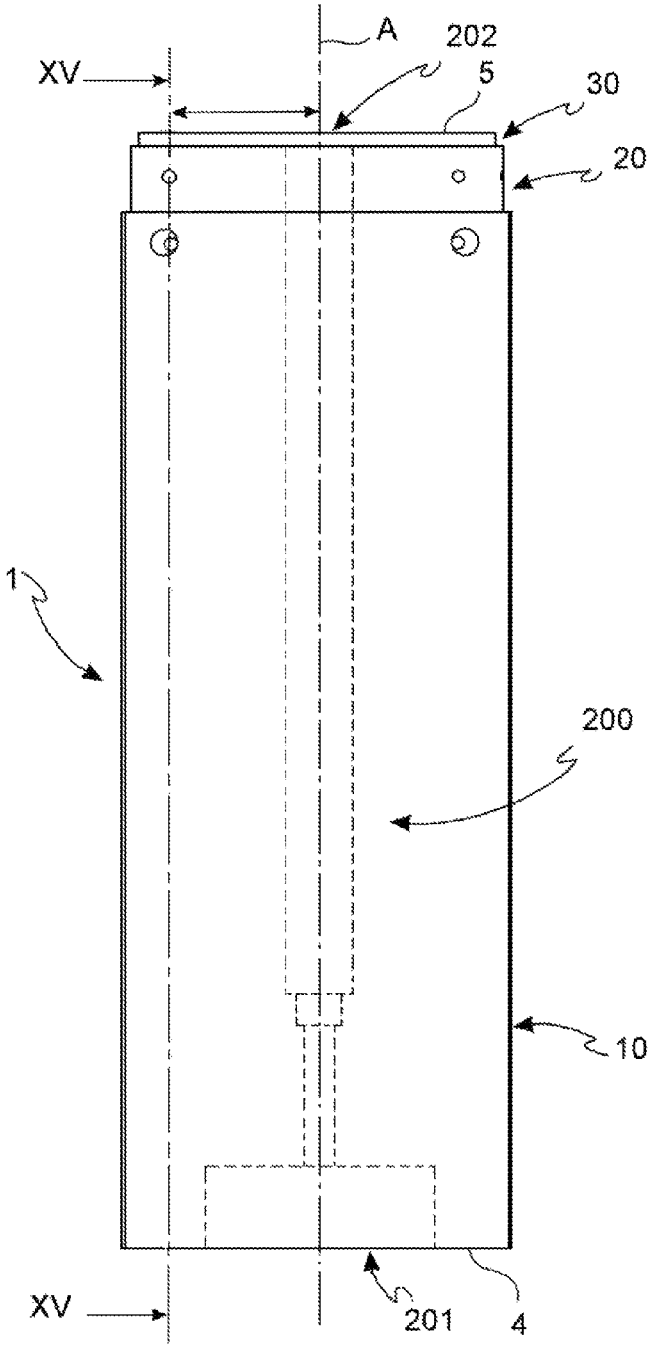
FIG. 14 shows the side view of FIG. 9, wherein the leg is in the retracted position.
Figure 15:
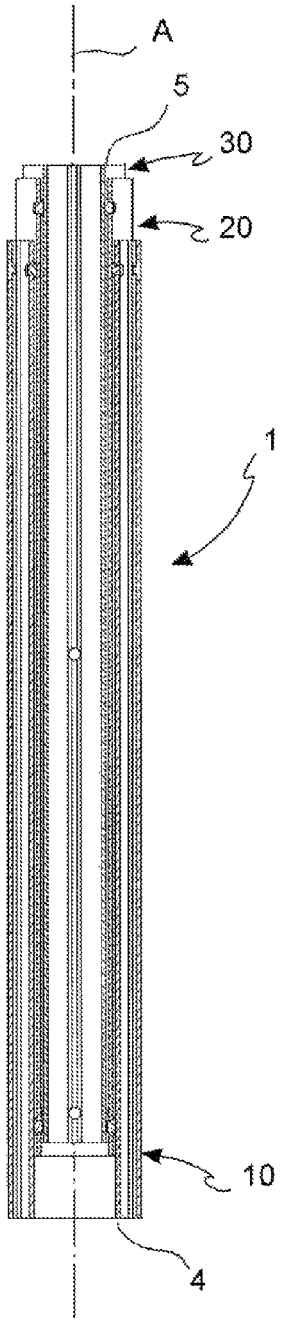
FIG. 15 shows the sectional view of FIG. 10, cut a plane of a sectional plane XV coincident with the sectional plane X.
Figure 24:
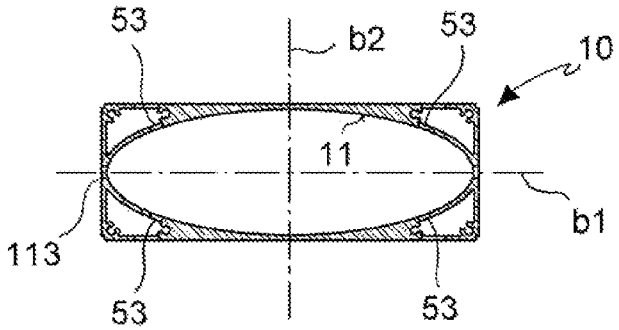
FIG. 24 shows a cross section, cut by a plane XXIV orthogonal to the extension axis, of the bottom end member of the leg of FIG. 4.
Figure 25:
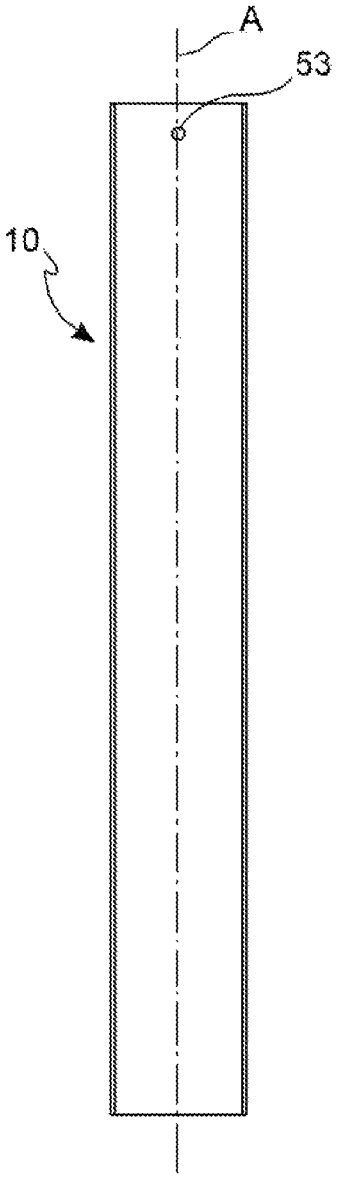
FIG. 25 shows a side view of such bottom end leg member, in a direction orthogonal to the extension axis and in a direction parallel to the major axis of the cross section.
Figure 26:
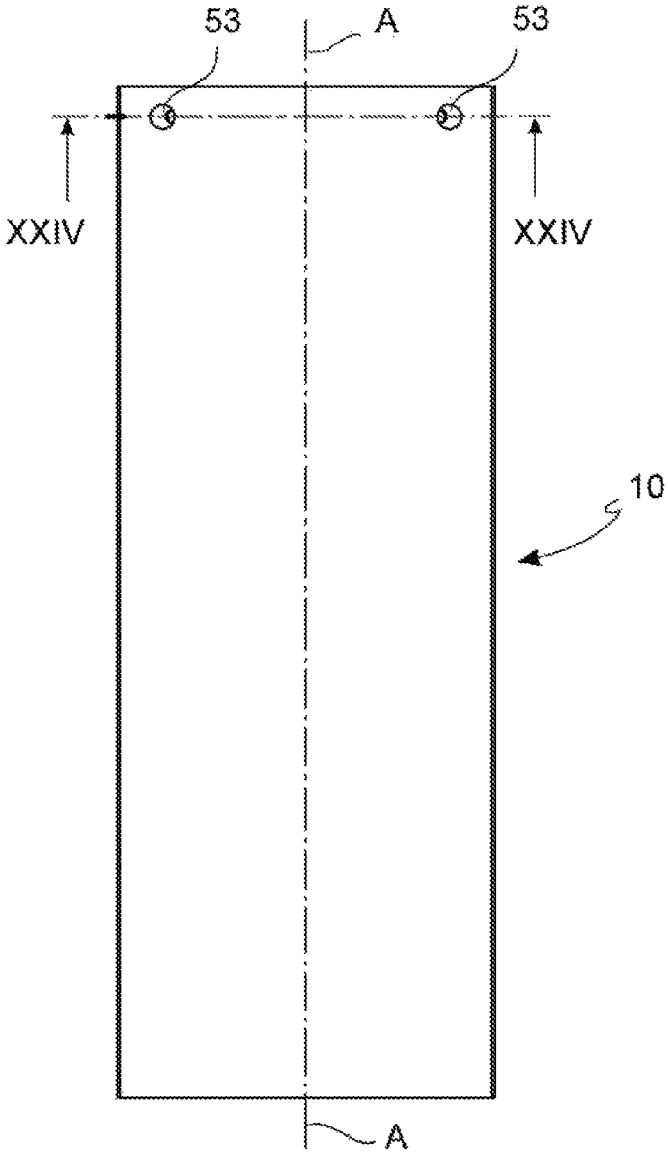
FIG. 26 shows a side view of such bottom end leg member, in a minor axis direction of the elliptical cross section.
Figure 27:
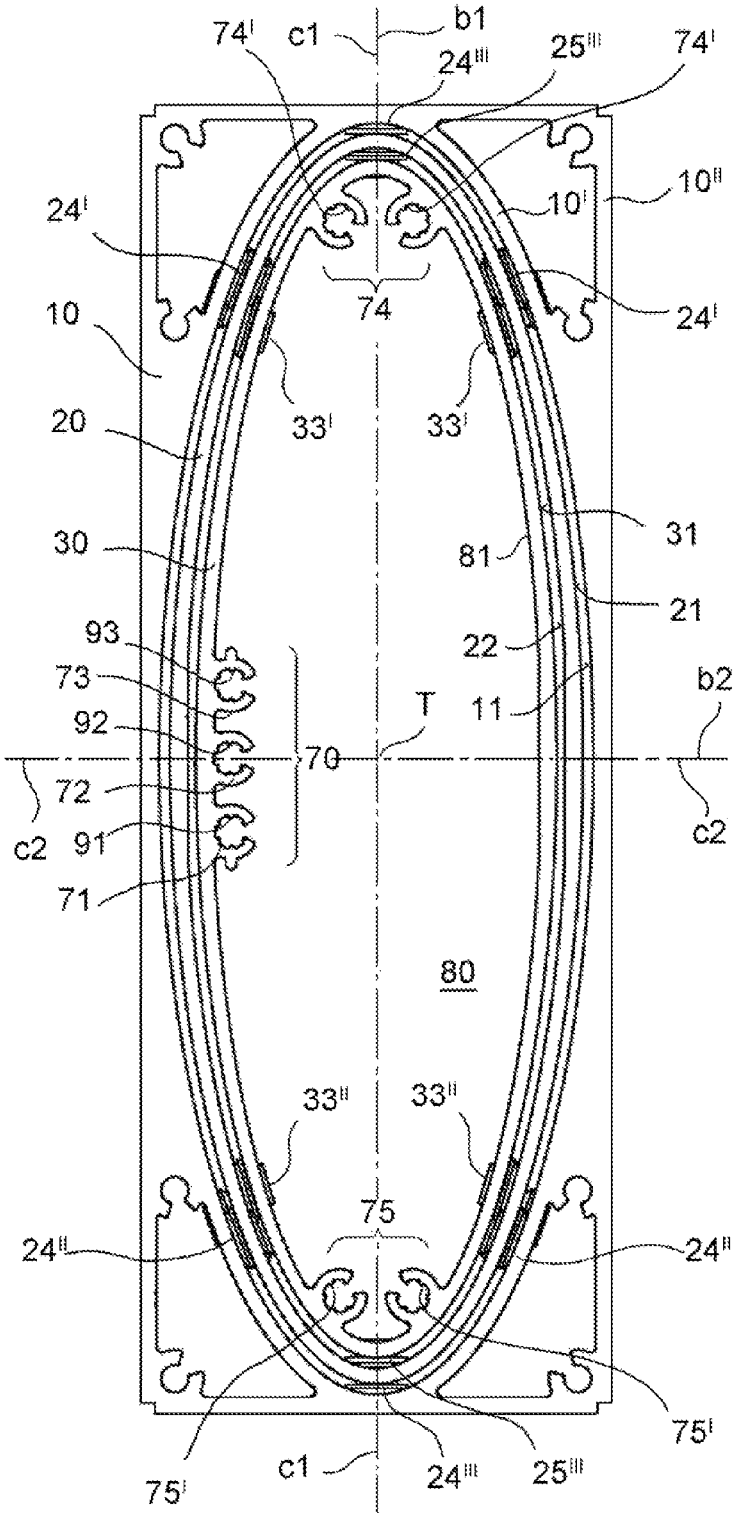
FIG. 27 shows a plan view, or along the extension axis, of the adjustable leg of FIG. 4, including a top end member of the leg, a central member of the leg and a bottom end member of the leg.
Figure 28:
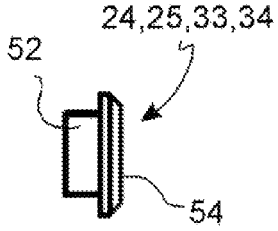
FIGS. 28 to 30 show, respectively, a side view and two perspective views of a pulling member for the adjustable leg according to the invention.
Figure 29:
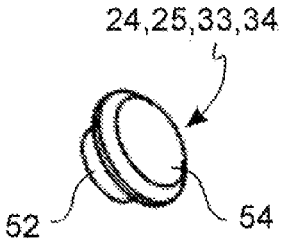
Figure 30:
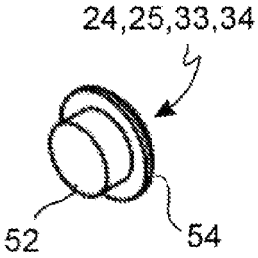

With reference to the figures, an adjustable leg for supporting a shelf, for example, a work-top, or a table-top, of a table, according to the invention, is indicated, as a whole, by reference 1.

Adjustable leg 1 extends along an extension axis A and is adjustable along such extension axis A, between a retracted, or lowered, position, wherein the leg has minimum length, and an extended, or raised, position, wherein the leg has maximum length.

In this description, the term "longitudinal" means in a direction parallel, or substantially parallel, to the extension axis A.

Adjustable leg 1 is, therefore, a telescopically extendable leg.

Adjustable leg 1 has a first end 4 and a second end 5, opposite to the first end.

The first end 4 is suitable to be directed towards a floor, for example, resting directly on the floor, or suitable to be fixed to a support base 2. Such base 2 can, then, be supported by, or fixed to, a floor or a wall.

The second end 5 is suitable to be fixed to a shelf 3, for example to a work-top, in particular to a bottom face of a work-top.

According to a preferred embodiment, the first end of leg 1 is fixed to a base 2, and the second end is fixed to the work-top. For example, leg 1 is mounted with its extension axis A in a direction orthogonal to a support surface of a base 2 suitable to be placed on the floor, for example the adjustable leg 1 is vertical. According to other embodiments, the adjustable leg can be mounted in a direction angled with respect to the vertical direction, for example, so that its extension axis A is horizontal.

The adjustable leg comprises a plurality of members, in particular, it comprises at least one base leg member 10, or first leg member 10, which is terminated with the first end 4, and a top leg member 30, or the last leg member 30, that is terminated with the second end 5, wherein the base leg 10 and the top leg member 30 slide telescopically each other along the extension axis A.

The main bundle 70 is arranged inside said first half of tubular member 30'.

According to one embodiment, each leg member 10, 20, 30 is defined by an outer surface 21, 31 and, in addition or alternatively, by an inner surface 12, 22 which extend around the extension axis (A).

According to one embodiment, the inner surface 12, 22 of a leg member 10, 20, 30 is configured to slidably receive inside it, the outer surface 21, 31 of an adjacent leg member 10, 20, 30 of the plurality of leg members, and the inner surface 12, 22 of a leg member is facing and complementary to the outer surface 21, 31 of an adjacent leg member 10, 20, 30.

According to one embodiment, the adjustable leg includes protruding contrast members 24, 25, 33, 34 that extend from one of the inner surface 12, 22 and the outer surface 21, 31 in a direction substantially transversal to the extension axis A, upon elastic contrast against the other of said inner surface 12, 22 and outer surface 21, 31 of an adjacent leg member 10, 20, 30.

Advantageously, the elasticity of the contrast members 24, 25, 33, 34 and the elasticity of the leg members 10, 20, 30 are dimensioned to form a tight fit between the leg member 10, 20, 30 and the adjacent leg member 10, 20, 30, to generate a static frictional force between said leg members 10, 20, 30 in the direction parallel to the extension axis A of the leg, in such a way that the force of static friction contributes to locking leg members 10, 20, 30 to each other in a resting position and counteracting an external force applied between the ends of the leg along the extension axis A.

According to one embodiment, the contrast members are made of a different material with respect to the material of the leg members, for example plastic.

According to one embodiment, the contrast members are made of a material having a Young's modulus greater than the Young's modulus of the material of the leg members.

The contrast members 24, 25, 33, 34 protrude transversely to the inner surface 12, 22 or outer surface 21, 31, to which they are fixed, for such a length as to form a coupling with interference between the adjacent leg members 10, 20, 30.

According to one embodiment, the plurality of leg members 10, 20, 30 comprises a base leg member 10 ending with a first end 4 of said leg 1 and a top leg member 30 ending with a second end 5 of said leg 1.

For example, the base leg member 10 is an extruded member, for example, made from aluminium or aluminium alloy.

The base leg member 10 has an inner surface 12 extending around the extension axis A for the entire length of base leg member 10. In other words, the inner surface 12 forms a longitudinal pass-through cavity.

According to a possible embodiment, the cross section of inner surface 12 of the base leg member 10 is a closed line with respect to extension axis A. In other words the base leg member 10 may be a tubular member.

According to a possible embodiment, base leg member is an extruded member, for example, made from aluminium or aluminium alloy.

The top leg member 30 is delimited by an outer surface 31 which extends for the entire length of this top leg member.

According to this embodiment, top leg member 30 is configured to slide inside the inner surface 12 of the base leg member 10, and is coupled with such portion of leg base through contrast members. In other words, the top leg member is coupled with the base leg member 10 by means of contrast members, avoiding the use of sliding guides or rolling bodies guides.

According to one embodiment, the adjustable leg 1 also comprises at least one intermediate member 20, slidingly interposed between the base leg member 10 and said top leg member 30.

Such at least one intermediate member 20 can be slidingly engaged with the base leg member 10 and the top leg member 30 by means of contrast members 24, 25, 33, 34.

In other words, the at least one intermediate member 20 is coupled with the top leg member 30 and with the base leg member 10, avoiding the use of sliding guides or rolling bodies guides.

Thus, according to this embodiment, the at least one intermediate member 20 is supported in its position, exclusively through contrast members 24, 25, 33, 34.

In other words, the at least one intermediate member is supported in its position and pulled during the mutual movement between top leg member 30 and base leg member 10, avoiding the use of means of movement or retention.

Thus, the at least one intermediate member 20 is pulled in its movement exclusively through the contrast members, by friction, avoiding being moved by movement mechanisms.

According to one embodiment, the at least one intermediate leg member 20 is an extruded member, for example, made from aluminium or aluminium alloy.

According to one embodiment, the at least one intermediate member 20 is externally defined by an outer surface 21 and internally by an inner surface 22.

The outer surface 21 and the inner surface 22 are parallel and coaxial to each other and extend for the entire length of the intermediate member.

In other words, the at least one intermediate member (20) is a tubular member.

According to one embodiment, the outer surface 21 of each intermediate leg member 20 is complementary to the inner surface of the next adjacent intermediate leg member or the inner surface 12 of base leg member 10, and the inner surface 22 of said each intermediate leg member is complementary to the outer surface 31 of a preceding adjacent leg member or the outer surface 31 of the top leg member 30.

In particular, an adjacent intermediate leg member precedes or follows an intermediate leg member 20, depending on whether it is located before or after the intermediate leg member 20 in the direction that goes from the first end 4 of the leg to the second end 5 of the leg, when the leg is in the extended position.

According to one embodiment, the at least one intermediate leg member 20 is one single intermediate leg member 20.

In other words, according to a preferred embodiment, the leg 10 comprises a base leg 10, a top leg member 30 and one single interposed intermediate member 20.

The outer surface 21 of the intermediate leg member 20 is complementary to the inner surface 12 of the base leg member 10, and the inner surface 22 of the intermediate leg member 20 is complementary to the outer surface 31 of the top leg member 30.

According to one embodiment, the top leg member 30 slides inside the intermediate member 20, and the intermediate member 20 slides inside of the base member 10.

According to one embodiment, a first plurality 34, 25 of said contrast members is mounted in a protruding manner from said outer surface 21, 31 of said at least one leg member 20, 30, along at least a first plane of distribution D' substantially orthogonal to the extension axis A, for example near an end 28, 38 of said leg member 20, 30, for example near a bottom end.

According to one embodiment, a second plurality 33, 24 of said contrast members is mounted in a protruding manner from said outer surface 21, 31 of said at least one leg member 10, 30, along at least one second plane of distribution D" substantially orthogonal to the extension axis A and, therefore, substantially parallel to D' and at a distance from the first plane of distribution D'. In other words, the second plane of distribution D" is in a substantially central position with respect to the length of leg member 10, 20 in the direction of extension A.

In a different embodiment, the position of the plurality of contrast members can be reversed, in the sense that the first plurality 34, 25 of said contrast members can be mounted in a protruding manner from said inner surface 12, 22 of said at least one leg member 20, 30, and even the second plurality of contrast members 24, 33 may be mounted in a protruding manner from said inner surface 12, 22 of said at least one leg member 20, 30.

Contrast members 24, 25, 33, 34 are distributed along the respective planes of distribution D' and D" in such a way as to balance the totality of pressure forces transverse to the extension axis A generated by the interaction between a leg member 10, 20, 30, an adjacent leg member and the contrast members, so as to align and guide a leg member 20, 30 inside the inner surface 12, 22 of an adjacent leg member 20, 10, in particular avoiding any further sliding contact between adjacent leg members.

According to one embodiment, the first plurality of contrast members 34, 25 is distributed in pairs of members opposed each other, aligned with each other so as to generate contrast forces aligned with each other and opposite, transverse to the extension axis A.

According to one embodiment, the second plurality of contrast members 33, 24 is distributed in pairs of members opposed each other, aligned with each other so as to generate contrast forces aligned with each other and opposite, transverse to the extension axis A.

According to a possible embodiment, each contrast member of the first plurality 25, 34 is aligned with a respective contrast member of the second plurality 24, 33 of the same leg member 20, 30, along a direction parallel to the extension axis A. This has the advantage of guiding the sliding of the adjacent leg members, avoiding angular displacements with respect to the extension axis A.

According to one embodiment, the leg according to the invention comprises stop members to limit the relative sliding between leg members at the limit position of fully extended leg and fully retracted leg.

For example, such stop members are protruding stop members 13, 23.

According to one embodiment, such protruding stop members 13, 23 are obtained through further contrast members.

According to one embodiment, contrast members 24, 25, 34, 33 include an engagement portion 52 suitable to engage a corresponding hole 53 in a respective leg member 10, 20, 30, for example through a pass-through hole.

In addition, contrast members 24, 25, 34, 33 comprise a contact surface 54, opposite to the engagement portion 52, suitable to make sliding contact against a facing inner or outer surface of an adjacent leg member.

According to a preferred embodiment, the cross sections according to sectional plane XVI, XVII, XX, XXI, XXIV transverse with respect to the extension axis A, of said inner surfaces 12, 22 and outer surfaces 21, 31, are ellipse having a major axis b1 and a minor axis b.

In other words, according to this embodiment, the outer surface 21, 31 is an extruded surface having elliptical cross section, for example, that extends with continuity of shape, for example without interruption of shape. Furthermore, the inner surface 12, 22 can be an extruded surface having elliptical cross section, for example, that extends with continuity of shape, for example without disruption of the shape.

For example, the first plurality of contrast members 25, 34 comprises a first pair of contrast members 25', 34' and a second pair of contrast members 25", 34" arranged peripherally with respect to the major axis b1 of the ellipse, in particular symmetrically with respect to the minor axis b2.

Similarly, the first plurality of contrast members 24, 33 comprises a first pair of contrast members 24', 33' and a second pair of contrast members 24", 33" arranged peripherally with respect to the major axis of b1 of the ellipse, in particular symmetrically with respect to the minor axis b2.

Furthermore, the first plurality 25, 34 of contrast members comprises a third pair of contrast members 25''', 34''' arranged at the opposite ends of the major axis b1.

Furthermore, the second plurality 24, 33 of contrast members comprises a third pair of contrast members 24''', 33''' positioned at the opposite ends of the major axis b1.

In other words, in the case of a leg having elliptical cross section, as shown, for example, in FIGS. 1-27, the contrast members are concentrated near side end portions of leg members 20, 30 along the major axis b1, leaving free the central area interposed between these side end portions.

This has the advantage of loading, by contrast forces exerted by the contrast members, only those lateral portions that are more mechanically resistant, leaving unloaded the central portions of the cross section of the leg members 20, 30, which are less resistant to compression.

This particular distribution of the contrast members allows obtaining an optimal distribution of the contrast forces along the outer and inner surfaces of the leg members.

Among other things, such a distribution of contrast members, associated with the elliptical shape of the cross section of the leg members, allows preventing the relative rotation of leg members 10, 20, 30 with respect to the extension axis A, avoiding the necessity of shoulders or protrusions from the outer or inner surfaces.

Figure 31:
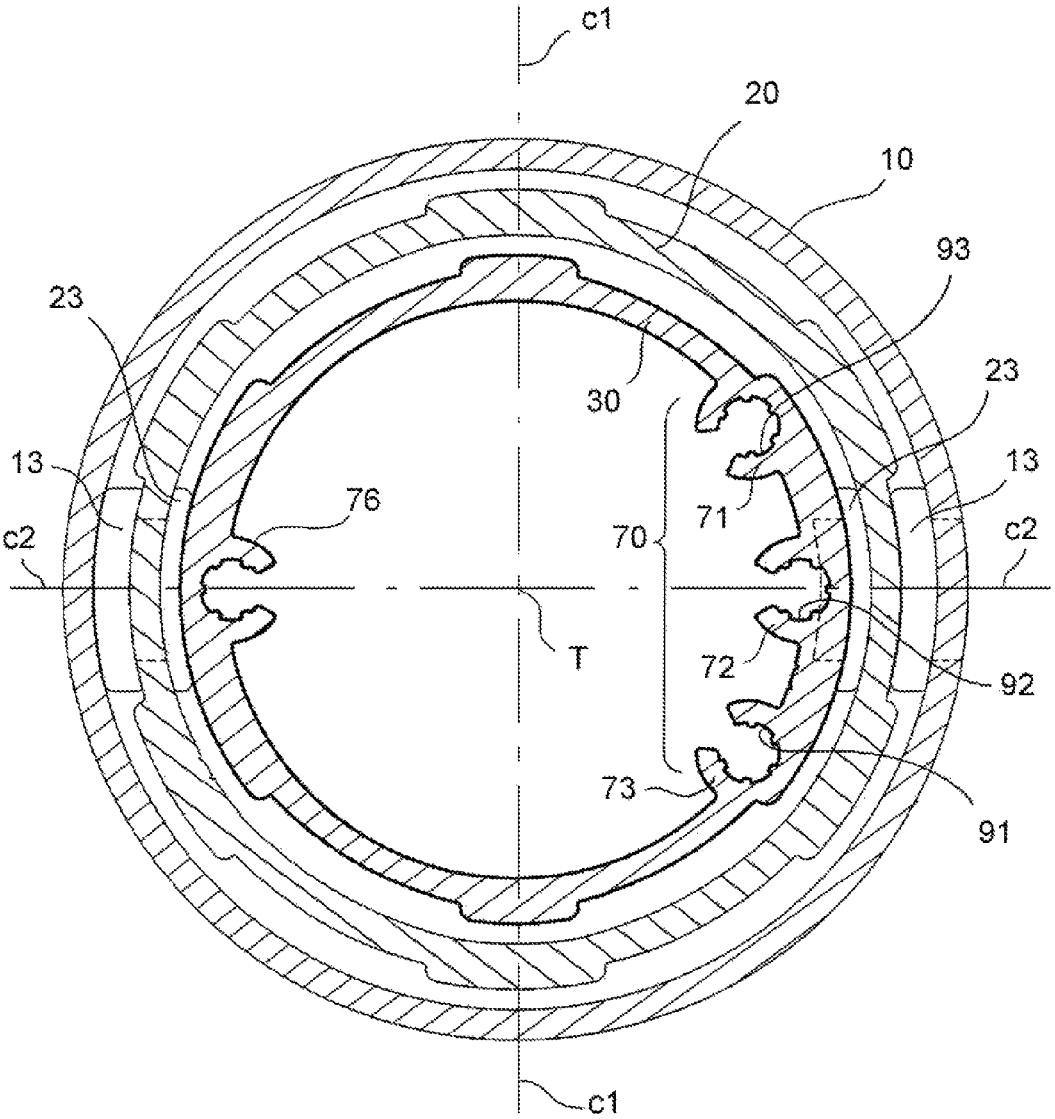
FIG. 31 shows a plan view of a further embodiment of the adjustable leg according to this invention, wherein the leg has a circular cross section.

According to another embodiment, leg members 10, 20, 30 can have a cross section transverse to the extension axis that is substantially circular, as shown in FIG. 31.

According to another aspect of the invention, the above purposes and advantages are obtained through a table comprising a table-top 3, and at least one adjustable leg 1, as described in this description, wherein adjustable leg 1 has a first end suitable to rest on a floor, or fixed to a support base 2, and a second end (5), opposite the first end 4, fixed to said table-top 3 for supporting said table-top 3 at an adjustable height above the floor.

The plurality of leg members comprising a first leg member 10 ending with said first end 4, suitable to rest on the floor or be fixed to a base, and a last leg member 30 ending with said second end 5 and suitable to be fixed to said table-top 3.

According to one embodiment, the last leg member 30 is a tubular extruded member defined internally by an inner surface of tubular member 81, and this last tubular member 30 defines a central axis substantially parallel to the extension axis A, and a first longitudinal plane C1 passing through central axis T.

The intersection between said first longitudinal plane C1 and the tubular member 30, defines a first half of tubular member 30' and a second half of tubular member 30".

Tubular member 30 comprises a main bundle 70 of longitudinal reinforcing ribs 71, 72, 73 that extend for the entire length of said tubular member 30 projecting from said inner wall 81 of tubular member 80 towards the inside 80 of tubular member 30.

The main bundle 70 is arranged inside said first half of tubular member 30'.

According to one embodiment, the main bundle of ribs 70 is arranged inside said first half of the tubular member 30', avoiding being arranged in the second half of the tubular member 30".

According to one embodiment, the main bundle of ribs 70 is arranged around the intersection between the first half of tubular member 30' and the second longitudinal plane C2.

According to one embodiment, the main bundle of ribs 70 extends for a width no greater than ⅖ of the width of the first half of tubular member 30' measured parallel to the first longitudinal plane C1.

According to one embodiment, the main bundle of ribs 70 extends for a width no greater than ⅕ of the width of the first half of the tubular member 30' measured parallel to the first longitudinal plane C1.

According to one embodiment, the bundle of ribs is centred with respect to the second longitudinal plane C2, in particular in a specular way with respect to longitudinal plane C2.

According to one embodiment, ribs 71, 72, 73 of the bundle 70 of the ribs are equi-spaced from each other.

For example, main bundle of ribs 70 is formed from an odd number of parallel ribs, with the central rib arranged along the second longitudinal plane C2.

According to one embodiment, the main bundle of ribs 70 is formed from three ribs 71, 72, 73, in which the central rib 72 is arranged along second plane C2.

According to one embodiment, all of the ribs of the main bundle of ribs 70 are substantially equal to each other.

According to one embodiment, the main bundle of ribs 70 is arranged in an asymmetric way with respect to the first longitudinal plane C1 and in a symmetric way with respect to second longitudinal plane C2.

According to one embodiment, the ribs of the main bundle of ribs 70 are concentrated in the first half of tubular member 30'. In this way, the telescopic leg is particularly suited to supporting a tensile load generated by the bending torque described above.

According to one embodiment, the telescopic leg includes at least one further longitudinal reinforcing rib 74, 75, 76 that extends for the entire length of said tubular member 30 projecting from inner wall 81 of tubular member 80 towards the inside of the tubular member 30, wherein at least one further longitudinal reinforcing rib 74, 75, 76 is arranged asymmetrically with respect to first longitudinal plane C1 and symmetrically with respect to second longitudinal plane C2.

According to one embodiment, the cross section of said tubular member 30, orthogonally to the central axis T, is a flattened cross section which extends further in a first direction b1 substantially orthogonal to a direction of cantilever of the work-top, with respect to a second direction b2 substantially parallel to said direction of cantilever. For example, the first direction coincides with major axis b1 of the elliptical cross section, and the second direction coincides with minor axis b2 of the elliptical cross section.

According to one embodiment, the total number of ribs present in said first half 30' of the tubular member is greater than the total number of ribs present in the second half of tubular member 30". This serves to reinforce tubular member 30 only on the side opposite to the direction of projection of the table, where the leg is most stressed in traction.

According to one embodiment, tubular member 30 comprises two second groups of ribs 74, 75, in particular substantially equal to each other, arranged near the first longitudinal plane C1 and opposite sides with respect to second longitudinal plane C2.

According to one embodiment, at least one rib 71, 72, 73 of the bundle of ribs 70 comprises a respective longitudinal channel 91, 92, 93 that passes through said at least one rib 71, 72, 73 parallel to the central axis T of the tubular member.

In particular, said at least one longitudinal channel 91, 92, 93 is suited to receiving and retaining a fixing screw in a longitudinal direction, in particular for fixing a table-top 3 of a table to said tubular member 30.

According to one embodiment, each of the ribs 71, 72, 73 of the main bundle 70 includes a respective longitudinal channel 91, 92, 93. For example all of the longitudinal channels are equal to each other.

According to one embodiment, said at least one longitudinal channel 91, 92, 93 is open towards the inside 80 of tubular member 30.

According to one embodiment, said at least one longitudinal channel 91, 92, 93 comprises a plurality of internal indentations that extend in a direction parallel to the central axis T. These indentations have the purpose of facilitating the tightening and retention of the fixing screws.

According to one embodiment, the ribs of the main bundle of ribs 70, and of the at least one further rib 76, of the second rib groups 74, 75, are all substantially equal to each other.

According to one embodiment, the at least one further rib 76 includes a longitudinal channel similar to that of the ribs of the main bundle of ribs 70.

According to one embodiment, each rib of the second rib groups 74 and 75 comprises a respective channel 74', 75', with the same characteristics as the channel of the ribs of the main bundle of ribs 70.

According to one embodiment, the cross section of the tubular member 30, orthogonally to central axis T, is an elliptical cross section having a major axis b1 and a minor axis b2, wherein the major axis b1 belongs to the first longitudinal plane C1 and wherein the minor axis b2 belongs to the second longitudinal plane C2.

According to one embodiment, the cross section of the tubular member 30, orthogonally to central axis T, is a substantially circular cross section.

According to one embodiment, at least one leg member 10 of the plurality of leg members 10, 20, 30 is an extruded member comprising an internal tubular portion 10' with elliptical cross section contained and inscribed in an outer tubular portion 10" with rectangular cross section, wherein each side of said portion of rectangular cross section 10" is centrally coupled with said portion of elliptical cross section 10'.

The inner tubular portion is obtained in one piece together with the outer tubular portion forming an extruded profile of very high structural strength.

This base leg member 10, together with tubular member 30 having main bundle of ribs 70, produces a combined effect of considerable reinforcement of the entire leg, at any length of extension of the telescopic leg.

This base leg member 10 allows firm fixing to a base 2, as it shows a transverse surface for fixing to the base 2.

According to one embodiment, tubular member 30 is the top leg member and the extruded member 10 is the bottom or base leg member.

According to another aspect of the invention, the above purposes and advantages are satisfied by a table comprising a table-top 3, and at least one adjustable or telescopic leg 1, as described above.

In particular, this adjustable leg 1 has a first end 4 suited to resting on a floor or fixed to a support base 2, and a second end 5, opposite to first end 4', fixed to said supporting surface 3 to support said table-top 3 at an adjustable height above the floor, wherein the second end of said at least one adjustable leg 1 is fixed to the table-top 3 near a peripheral edge 3' of table-top 3 and so that the bundle of ribs 70 is arranged towards the outside of table-top 3.

According to one embodiment, the cross section extends mostly in a direction substantially orthogonal to a direction of cantilever of the work-top, with respect to a direction substantially parallel to said direction of cantilever.

According to one embodiment, adjustable or telescopic leg 1, comprises a linear actuator 200 extensible between a minimum length and a maximum length, in particular contained and hidden inside leg 1.

This linear actuator 200 has a first end 201 fixed to bottom or base leg 10, and a second end 202, opposite to first end 201, fixed to top leg member 30, so that when actuator 200 lengthens, leg 1 also lengthens, and when actuator 200 shortens, leg 1 also shortens.

For example, first end 201 of actuator 200 is fixed to first end 4 of the leg, and the second end of actuator 200 is fixed to the second end of the leg 1.

According to one embodiment, actuator 200 comprises a motor, for example an electric motor, and a screw-and-nut system.

Alternatively, a pneumatic or hydraulic linear actuator can be used.

To the embodiments of the device described above, the skilled person, to satisfy contingent needs, may make modifications, adaptations and replacements of members with others functionally equivalent, without departing from the scope of the following claims. Each of the characteristics described as belonging to a possible form of embodiment can be achieved independently from the other embodiments described.

The invention claimed is:

1. A telescopic leg for supporting a table-top of a table, said leg defining an extension axis, a first end of the leg, and a second end of the leg, opposite the first end, wherein a length of the leg between the first end and the second end is adjustable between a minimum length and a maximum length, wherein said telescopic leg comprises:

a plurality of leg members mutually slidingly engaged along the extension axis;

said plurality of leg members comprising a first leg member ending with said first end, suitable to be rested or secured to a fixed surface or a base, and said plurality of leg members comprising a last leg member ending with said second end and suitable to be secured to said table-top;

wherein said last leg member is an extruded tubular member internally defined by a tubular member inner surface;

said tubular member defining a central axis substantially parallel to said extension axis, and a first longitudinal plane passing through said central axis, and a second longitudinal plane passing through the central axis and orthogonal to the first longitudinal plane;

wherein an intersection between said first longitudinal plane and the tubular member defines a first tubular member half and a second tubular member half;

wherein said tubular member comprises a main bundle of longitudinal reinforcing ribs extending throughout an entire length of said tubular member projecting from said tubular member inner surface inwardly of the tubular member; and wherein said main bundle is completely arranged in said first tubular member half, avoiding to be arranged in the second tubular member half, wherein said main bundle of ribs is centered with respect to the second longitudinal plane in a specular way with respect to the second longitudinal plane, and the main bundle of ribs is arranged around the intersection between the first tubular member half and the second longitudinal plane;

wherein the main bundle of ribs is formed by an odd number of parallel ribs, wherein a central rib of bundle of ribs is arranged along the second longitudinal plane; and wherein each rib of said main bundle of ribs comprises a longitudinal channel, configured for receiving and holding a securing screw in a longitudinal direction for securing the table-top of a table to said last leg member.

2. The telescopic leg according to claim 1, wherein the ribs of said main bundle of ribs are mutually equi-spaced and distributed along the tubular member inner surface in a symmetrical manner with respect to the second longitudinal plane passing through the central axis and orthogonal to the first longitudinal plane.

3. The telescopic leg according to claim 2, comprising at least one further longitudinal reinforcing rib extending throughout the entire length of said tubular member projecting from the tubular member inner surface towards the inside of the tubular member, said at least one further longitudinal reinforcing rib being arranged asymmetrically with respect to the first longitudinal plane and symmetrically with respect to the second longitudinal plane.

4. The telescopic leg according to claim 3, wherein a total number of ribs that are present in said first tubular member half is higher than a total number of ribs that are present in the second tubular member half.

5. The telescopic leg according to claim 3, wherein the ribs and said at least one further rib are substantially equal to each other.

6. The telescopic leg according to claim 2, wherein a cross section of said tubular member, orthogonally to the central axis, is an elliptical cross section having a major axis and a minor axis, wherein the major axis belongs to the first longitudinal plane, and wherein the minor axis belongs to the second longitudinal plane.

7. The telescopic leg according to claim 6, wherein said first leg member is an extruded member comprising an inner tubular portion having an elliptical cross-section contained and inscribed in an outer tubular portion having a rectangular cross-section, wherein each side of said rectangular outer tubular portion is centrally joined to said elliptical inner tubular portion.

8. The telescopic leg according to claim 1, wherein a cross section of said tubular member, orthogonally to the central axis, is a substantially circular cross section.

9. A table comprising a table-top, and at least one adjustable leg according to claim 1, wherein said at least one adjustable leg has a first end suitable to be rested onto a floor, or secured to a support base, and a second end, opposite the first end, secured to said table-top for supporting said table-top at an adjustable height from the floor, wherein the second end of said at least one adjustable leg is secured to the table-top in proximity of a peripheral edge of said table-top and so that said main bundle of ribs is arranged towards the outside of the table-top.

10. The telescopic leg according to claim 1, wherein all the longitudinal channels of the ribs of the main bundle are equal to each other.

11. The telescopic leg according to claim 1, wherein the longitudinal channels of the ribs of the main bundle are open towards the inside of tubular member.

12. The telescopic leg according to claim 1, wherein each of the longitudinal channels of the ribs of the main bundle comprises a plurality of inner indentations extending in a direction parallel to the central axis.

13. The telescopic leg according claim 1, wherein the main bundle of ribs extends for a width no greater than ⅖ of the width of the first tubular member half measured parallel to the first longitudinal plane.

* * * * *